US007140156B1

(12) United States Patent
Lowe, Jr. et al.

(10) Patent No.: US 7,140,156 B1
(45) Date of Patent: Nov. 28, 2006

(54) SYSTEM FOR INSTALLATION OF DECKING TILES

(75) Inventors: Harold Edward Lowe, Jr., Thomasville, NC (US); Dalton Stewart Sexton, Denton, NC (US)

(73) Assignee: DLH Nordisk, Inc., Greensboro, NC (US)

( * ) Notice: Subject to any disclaimer, the term of this patent is extended or adjusted under 35 U.S.C. 154(b) by 219 days.

(21) Appl. No.: 10/254,688

(22) Filed: Sep. 25, 2002

(51) Int. Cl.
*E04F 15/024* (2006.01)
*E04B 5/43* (2006.01)

(52) U.S. Cl. ..... 52/263; 52/126.5; 52/126.6; 52/100; 411/475; 411/457

(58) Field of Classification Search ..... 52/126.5, 52/403.1, 480, 582.1, 263, 177, 581, 650.3, 52/100, 126.6, 126.7; 411/509, 510, 457, 411/461, 466, 467, 468, 475; 403/169, 174
See application file for complete search history.

(56) References Cited

U.S. PATENT DOCUMENTS

| | | | | | |
|---|---|---|---|---|---|
| 3,861,098 | A * | 1/1975 | Schaub | 52/98 |
| 3,974,614 | A | 8/1976 | Strong | |
| 4,279,109 | A * | 7/1981 | Madl, Jr. | 52/263 |
| 4,570,397 | A | 2/1986 | Creske | |
| 4,780,571 | A * | 10/1988 | Huang | 174/48 |
| 4,835,924 | A * | 6/1989 | Blacklin et al. | 52/263 |
| 4,996,804 | A * | 3/1991 | Naka et al. | 52/126.6 |
| 5,361,554 | A | 11/1994 | Bryan | |
| 5,363,560 | A | 11/1994 | Makow | |
| 5,367,853 | A | 11/1994 | Bryan | |
| 5,394,667 | A * | 3/1995 | Nystrom | 52/480 |
| 5,403,637 | A * | 4/1995 | Pickard et al. | 428/44 |
| 5,465,546 | A * | 11/1995 | Buse | 52/480 |
| 5,487,245 | A * | 1/1996 | Dazo et al. | 52/204.61 |
| 5,511,353 | A * | 4/1996 | Jones | 52/536 |
| 5,791,096 | A | 8/1998 | Chen | |
| 5,876,084 | A * | 3/1999 | Smith et al. | 296/39.1 |
| 6,189,289 | B1 * | 2/2001 | Quaglia et al. | 52/764 |
| 6,286,272 | B1 * | 9/2001 | Sandoz | 52/177 |
| 6,418,690 | B1 * | 7/2002 | Wheatley et al. | 52/480 |
| 2002/0026757 | A1 * | 3/2002 | Scissom et al. | 52/220.2 |
| 2004/0020153 | A1 * | 2/2004 | Huang | 52/582.1 |

OTHER PUBLICATIONS

Information from the Internet from Scott Supply Service, Inc.-Electronic Catalog; Christmas Tree Fastener; Copyright 1998.
Infornation from the Internet; ITW Fastex; Copyright 2002.
Information from the Internet; Bison Screwjack Products; undated.
Brochure from DLH Group entitled "iDeck"; undated.

* cited by examiner

*Primary Examiner*—Rober Canfield
(74) *Attorney, Agent, or Firm*—MacCord Mason PLLC

(57) ABSTRACT

Materials for use in installing a deck include a plurality of decking tiles, each of the tiles having an outside corner angle with a hole at a predetermined location with respect to the corner and a plurality of decking tile connectors. Each of the connectors includes a plate, spacer flanges upstanding from the plate arranged to divide the plate into quadrants defined by angles that are the same as the corner angles of the tiles, and Christmas tree fasteners upstanding in the quadrants at locations to align with the holes in the tiles.

33 Claims, 8 Drawing Sheets

SYSTEM FOR INSTALLATION OF DECKING TILES

BACKGROUND OF THE INVENTION

The present invention relates to a system for installation of decking tiles for a deck or walkway including a plurality of decking tiles and a plurality of decking tile connectors having fasteners to affix to the decking tiles. Wooden decking tiles have been installed with the use of adjustable height plastic support pieces. The pedestals are adjustable for height to make the decking tile level, and four pedestals are generally required to install one wooden decking tile. These pedestals come in a variety of sizes and shapes. There are some pedestals that are not height adjustable. Examples of both are Bison screwjacks available from Bison Screwjack Company, Shoshone Drive, Denver, Colo. 80204. Bison screwjacks merely hold corners of tiles by gravity, without any positive engagement of the tile and connector.

Decking tiles may also be installed on joists, which are appropriately spaced in order to receive the decking tiles. In the joist type installation, the joists need to be spaced apart to receive the edges of two decking tiles. The use of joists requires that the tiles be affixed by driving nails or screws through the tiles into the joist. There is an aesthetic problem with the utilization of screws or nails, because the heads of the screws or nails show on the decking tile after installation. Nails can work up, so that the nail head becomes raised above the deck surface. The exposed nail head can permit water in the nail hole and cause rotting of the wooden tile material. The exposed nail head could be a hazard, causing an individual to trip.

When using screws to attach the tiles, one method to improve the aesthetic problem is to countersink the screws into the decking tile and plug the hole with a material that provides an aesthetic appearance. But this process is expensive and time consuming.

Furthermore, the prior art approach that uses screws or nails to affix decking tiles to joists generally only work well with softwood and not hardwood tiles. Hardwood tiles are difficult to drive screws into, to be held in place on the decking structure. There is a need therefore to provide a system of deck tile installation that permits hardwood decking material to be easily and quickly secured on a base, without the need of nails or screws.

SUMMARY OF THE INVENTION

The present invention fulfills one or more of these needs in the art by providing a system for installing decking tiles including a plurality of decking tiles and a plurality of tile connectors, having fasteners to affix the decking tiles in place. A preferred decking tile material is IPE wood made up of fluted wood slats. The decking material may also be a bankirai (yellow balau) a far eastern hard wood, as well as softwood or composites of plastic, wood, cellulose, and paper fiber.

The decking tile may be constructed of fluted wood slats fastened to support slats with screws. The decking tiles may be square or rectangular, and they are typically fastened in a manner to provide equal spacing between each slat which forms the decking tile. The decking tile has right-angled corners that include a drilled hole at a predetermined distance from the apex of the corner. The decking tile may also include a diagonal support slat. The use of the diagonal support slat provides greater strength to the decking tile.

The decking tile connector is typically made of a molded plastic and includes a flat plate. The decking tile may be circular, rectangular, or square. The decking tile typically includes spacer flanges arranged at 90° to each other. These spacer flanges provide predetermined spacing between the decking tiles after the tiles have been installed on the decking tile connector. The decking tile connector includes Christmas tree fasteners which are upstanding in the corners of the quadrants formed by the spacer flanges. The Christmas tree fasteners are preferably made of molded plastic.

Before installing the decking tiles on the decking tile connector, the specific area where the deck installation is designated needs to be prepared. The surface of the area is preferably flat and level. Once the area is leveled, the decking tile connectors may be placed on the surface and decking tiles may be installed. If some irregularities in the surface levelness remain, height adjustable connectors may be used and adjusted to create a plane for the tiles. The decking tiles are installed by placing the corners with the holes over the Christmas tree fasteners which are in each of the quadrants formed by the spacer flanges in the decking tile connector. In this manner, one decking tile connector retains a corner of up to four decking tiles. Additional decking tile connectors may be placed on the surface of the area and connected to already-laid tiles and additional decking tiles may be put in place. This process is repeated until the installed decking tiles cover the desired area for the deck installation.

The decking tile connectors may have weakened slotted lines in the quadrants. These lines permit the decking tile connector to be broken easily so as not to protrude from the underside of the edges of the deck.

Once installed in this manner, the decking tiles are solidly supported by the surface below the decking tile connector. The weight of the decking tiles and the engagement of the Christmas tree fasteners in the tiles keep the decking tiles in place.

These and other aspects of the present invention will become apparent to those skilled in the art after reading the following description of the preferred embodiments when considered with the drawings.

BRIEF DESCRIPTION OF THE DRAWINGS

The invention will be better understood by reading the description of examples of the invention along with the review of the drawings in which.

DESCRIPTION OF EXAMPLES OF THE INVENTION

Figure 1:
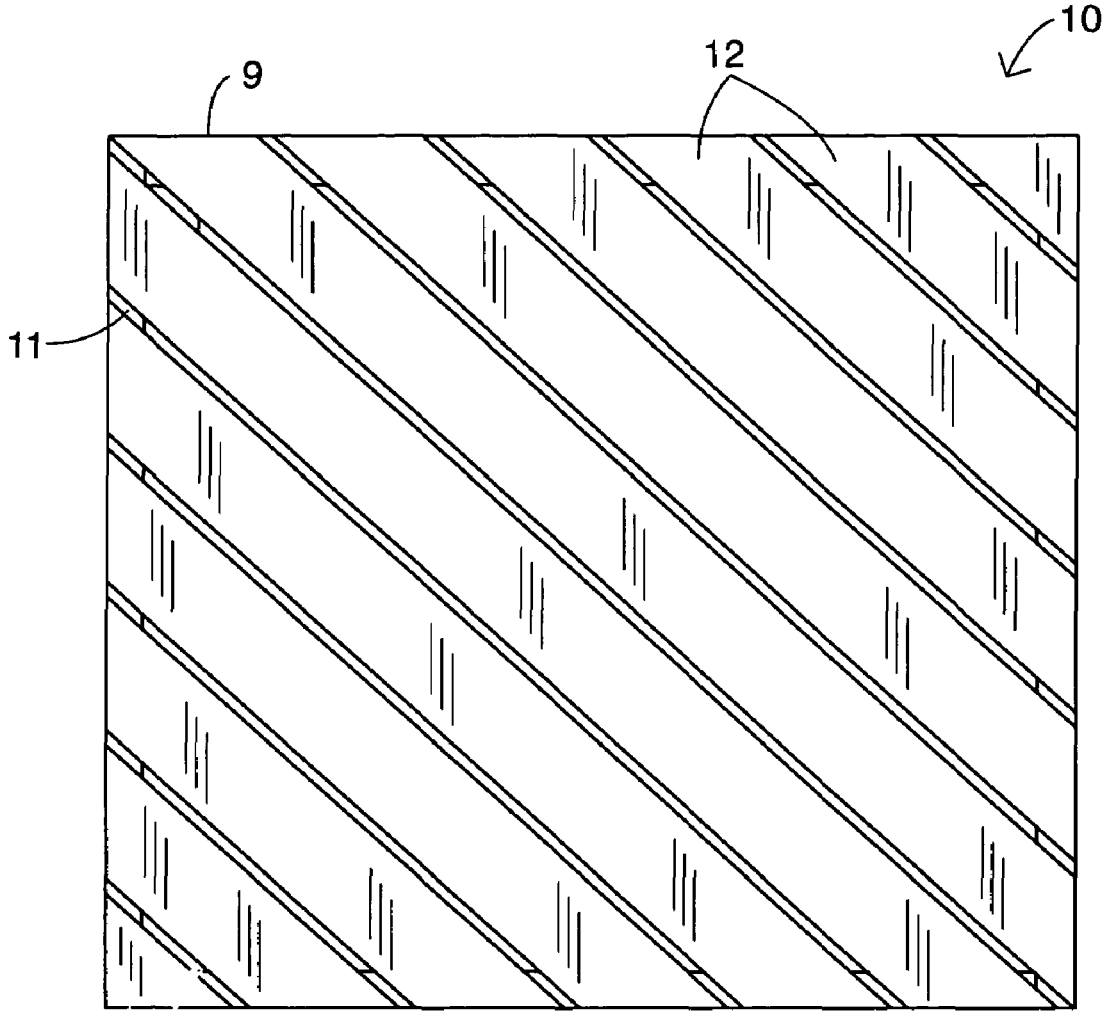
FIG. 1 is a top view of a decking tile according to one embodiment of the invention.

In the following description like reference characters designate like or corresponding parts throughout the several figures. It should be understood that the illustrations are for the purpose of describing preferred embodiments of the invention and are not intended to limit the invention thereto.

FIG. 1 shows a decking tile 10 embodiment of the invention. The decking tile 10 is constructed of fluted wooden slats 12. Each slat 12 may be made of IPE wood and is approximately 15 mm thick×65 mm wide, and of variable length. As shown in FIG. 1, the slats 12 are mounted at a diagonal and secured to support slats at the deck tile edges 9, 11 with screws or other fasteners (not shown). The decking tile 10 is typically square or rectangular. Other materials besides IPE may be used, but the invention is particularly advantageous for hard, difficult to penetrate materials, like hardwoods.

Figure 2:
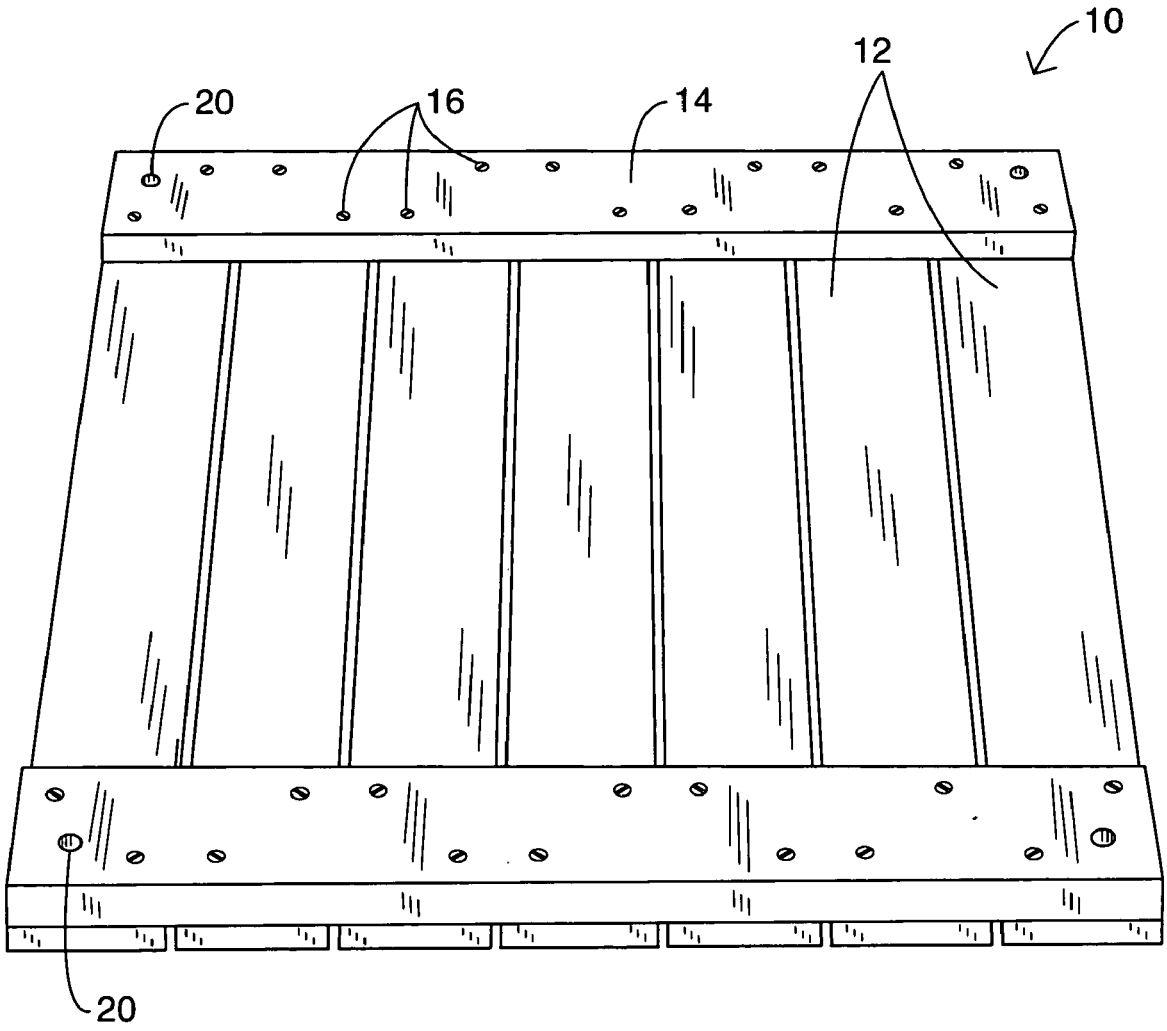
FIG. 2 is a bottom view of an alternate decking tile embodiment.

FIG. 2 depicts the bottom of an alternate decking tile 10. The decking tile 10 comprises a plurality of fluted IPE slats 12. In this embodiment, fluted slats 12 are fastened to perpendicular support slats 14. The slats 12 are equally spaced apart as they are placed on and secured to the parallel support slats 14. The slats 12 are affixed to the support slats 14 with fasteners 16. The fasteners 16 are generally stainless steel screws, but other fasteners or fastening means may be used.

In another embodiment, the decking tile 10 may include a diagonal support slat (not shown) adjoining the parallel support slats 14. The addition of the diagonal support slat gives the decking tile 10 additional strength.

The fluted wooden slats 12 and the parallel support slats 14 may be made of hardwood, softwood, composites of plastic, wood, cellulose and paper fiber. In the preferred embodiment, the decking tile 10 is constructed of IPE or bankirai (yellow balau) a far eastern hardwood. The decking tiles 10 include four right-angled corners. A hole 20 is drilled at a predetermined distance from the apex of each of the corners of the decking tiles 10, as seen in FIG. 2. Similar holes are provided in the tile of FIG. 1. All of the foregoing assembly and machining can take place in a factory, where power equipment is readily available to work on the hardwoods.

Figure 3:
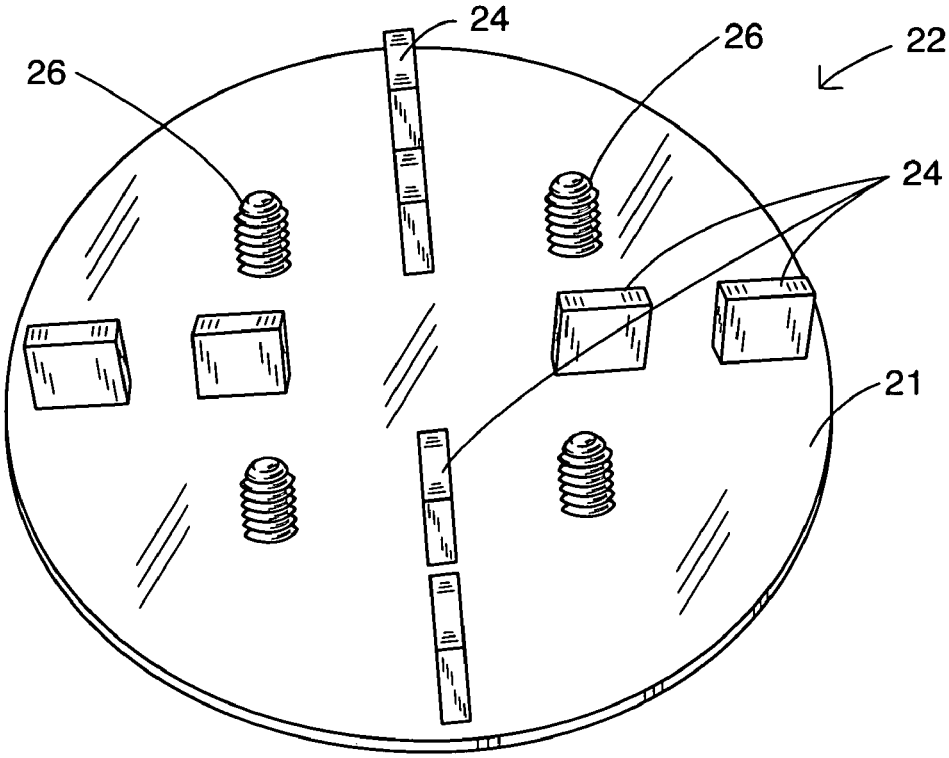
FIG. 3 is a top view of the decking tile connector, according to an embodiment of the invention.

A top view of an embodiment of the decking tile connector 22 is depicted in FIG. 3. The decking tile connector 22 is made of molded plastic and includes a flat plate 21. The plate 21 may be circular, rectangular, square, or other shape. The decking tile connector has spacer flanges 24 arranged at 90° to each other. The spacer flanges 24 provide spacing between the decking tiles after the decking tiles 10 have been installed on the decking tile connector 22. The spacing is defined by the thickness of the flanges. The decking tile connector 22 further includes "Christmas tree" fasteners 26 which are located in holes in each of the 90° sectors or quadrants formed by the spacer flanges 24. These Christmas tree fasteners 26 are made of molded plastic and include a rigid stem with a plurality of ribs of some rigidity but able to flex when stressed. Such "Christmas tree" fasteners are known in automobile construction, but to Applicant's knowledge, have not been used in working with deck tiles. The preferred fastener 26 has an outside diameter of 0.375 inch and an "inside" diameter of 0.3438 inch and height of 0.75 inch. The hole 20 in the tile is preferably of a diameter between the inside and outside diameters of the Christmas tree fastener. The locations of the fasteners in the quadrants match the locations of the holes 20 in the tiles. That is, their location in the quadrant of the connectors with respect to the 90° angle formed by the flanges matches the hole location with respect to the tile edges.

Preferably the hole 20 and fastener 26 are positioned to be aligned when the edges of the tile abut the flanges 24 at both edges of the tile. The hole 20 and fastener 26 are typically on a diagonal line that bisects the angle between the flanges 26. However, other placements may be used. The distance from the apex of the corner is preferably such as to avoid being so close to the edge as to risk splintering or a break-out of the wood, and to be within the plate 21, so as to be securely mounted.

Figure 4:
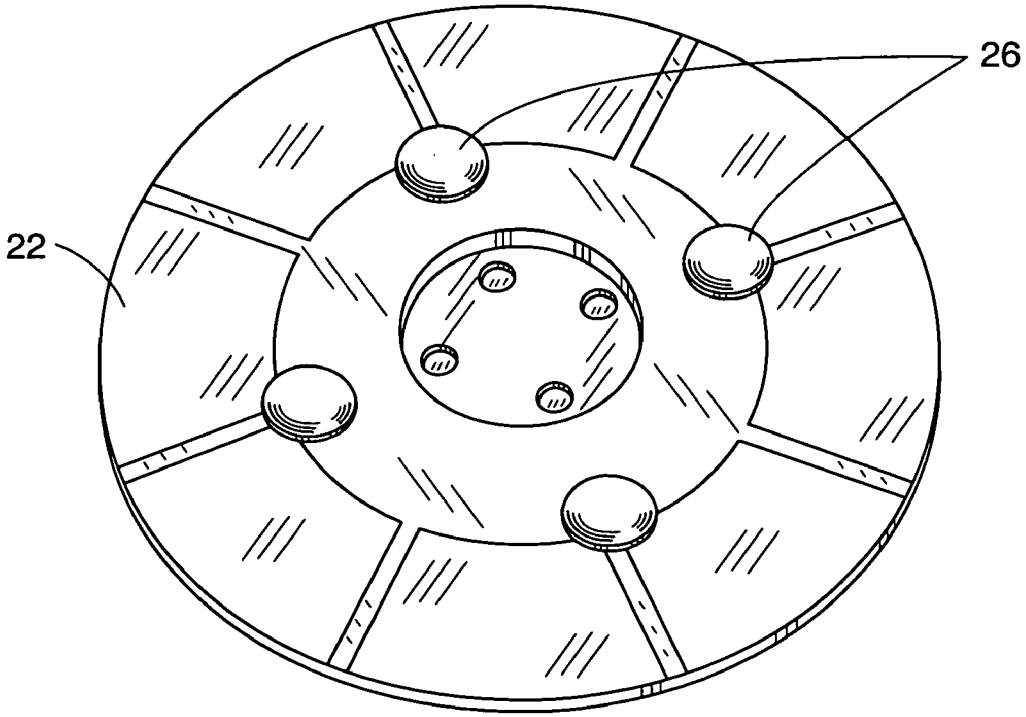
FIG. 4 is a bottom view of the decking tile connector of FIG. 3.

Referring to FIG. 4, a bottom view of the decking tile connector 22 is depicted. FIG. 4 shows the heads of Christmas tree fasteners 26 located within the four quadrants of the decking tile connector 22.

Figure 5:
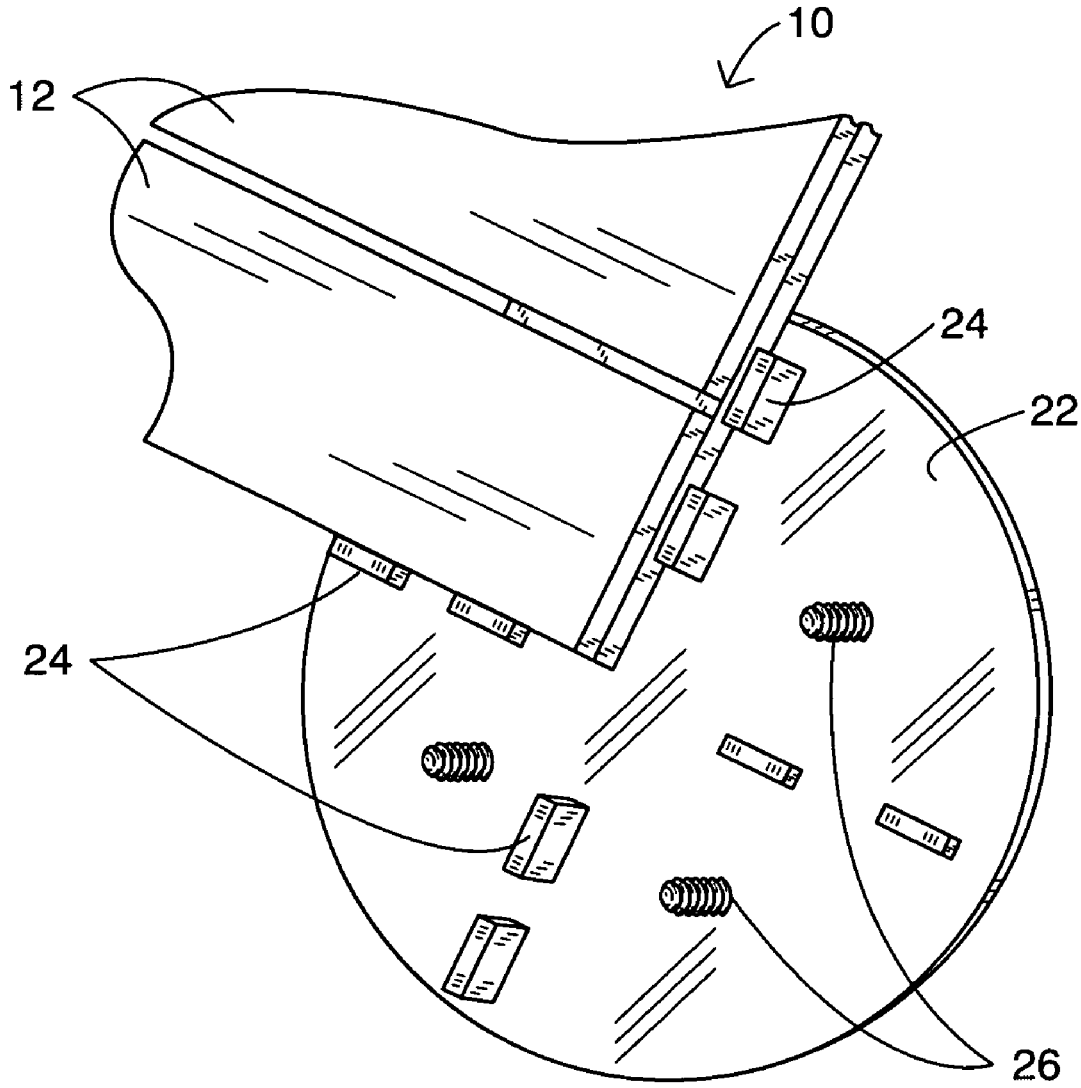
FIG. 5 is a top view of a decking tile connected to the decking tile connector of FIG. 3
Figure 5A:
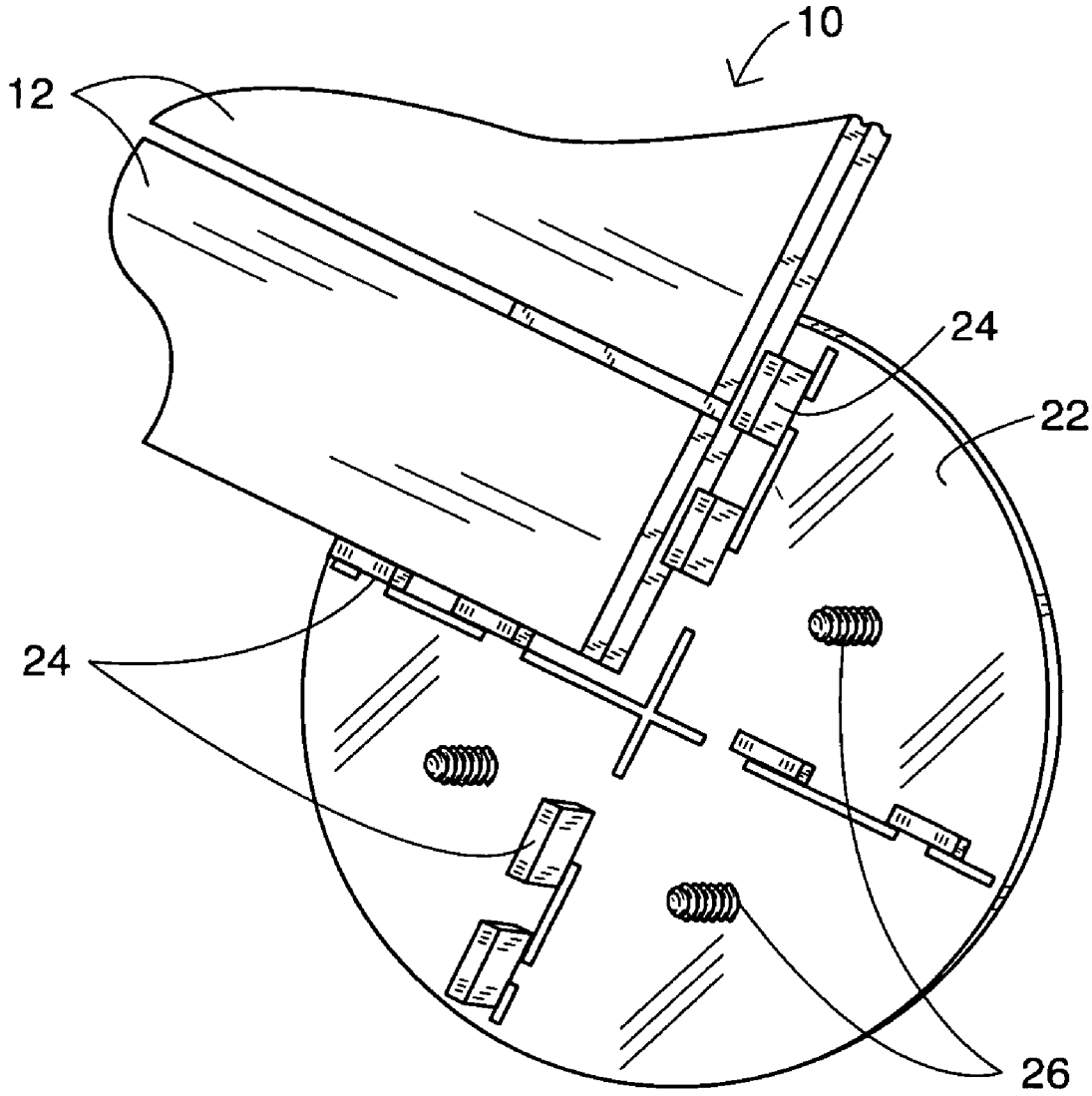
FIG. 5A shows a modified version.

FIG. 5 shows a partial decking tile installation. The decking tile 10 is placed upon the decking tile connector 22. The hole 20 (not shown in FIG. 5) which has been drilled in the corner of the decking tile 10 receives one of the Christmas tree fasteners 26 on the decking tile connector 22. The decking tile connector 22 can accommodate four decking tiles 10 in the installation process. Additional connectors are placed at the corners of the installed tiles, in like fashion, and additional tiles are installed, in repetitive fashion to complete the deck. The decking tile connector 22 may further include weakened slotted lines (shown in FIG. 5*a*) adjacent the flanges in each of the 90° quadrants. The weakened slotted lines permit the decking tile connector 22 to be evenly broken off to avoid the connectors extending past the edge of the deck.

Figure 6:
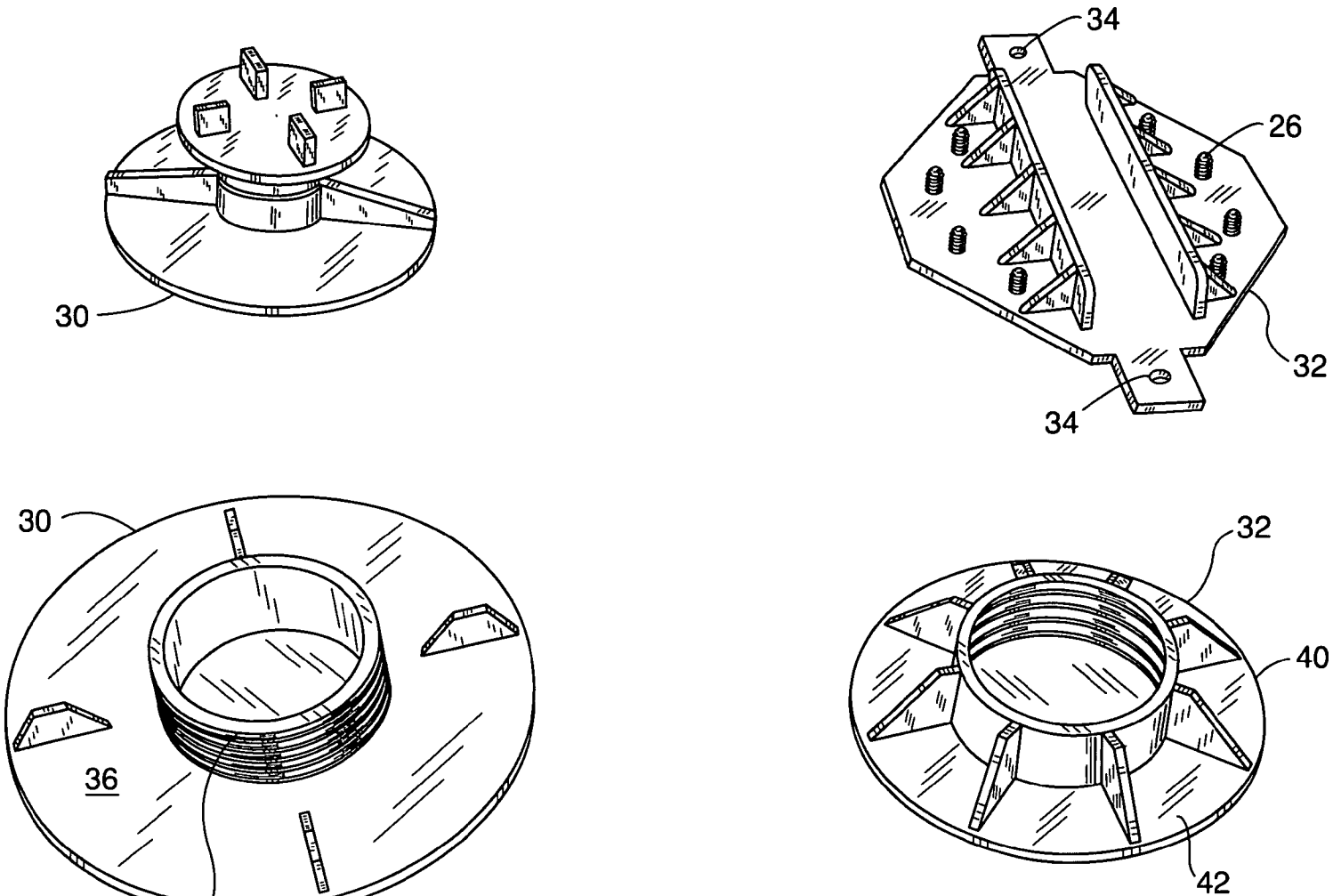
FIG. 6 is a top view of two alternate embodiments of decking tile connectors.
Figure 7:
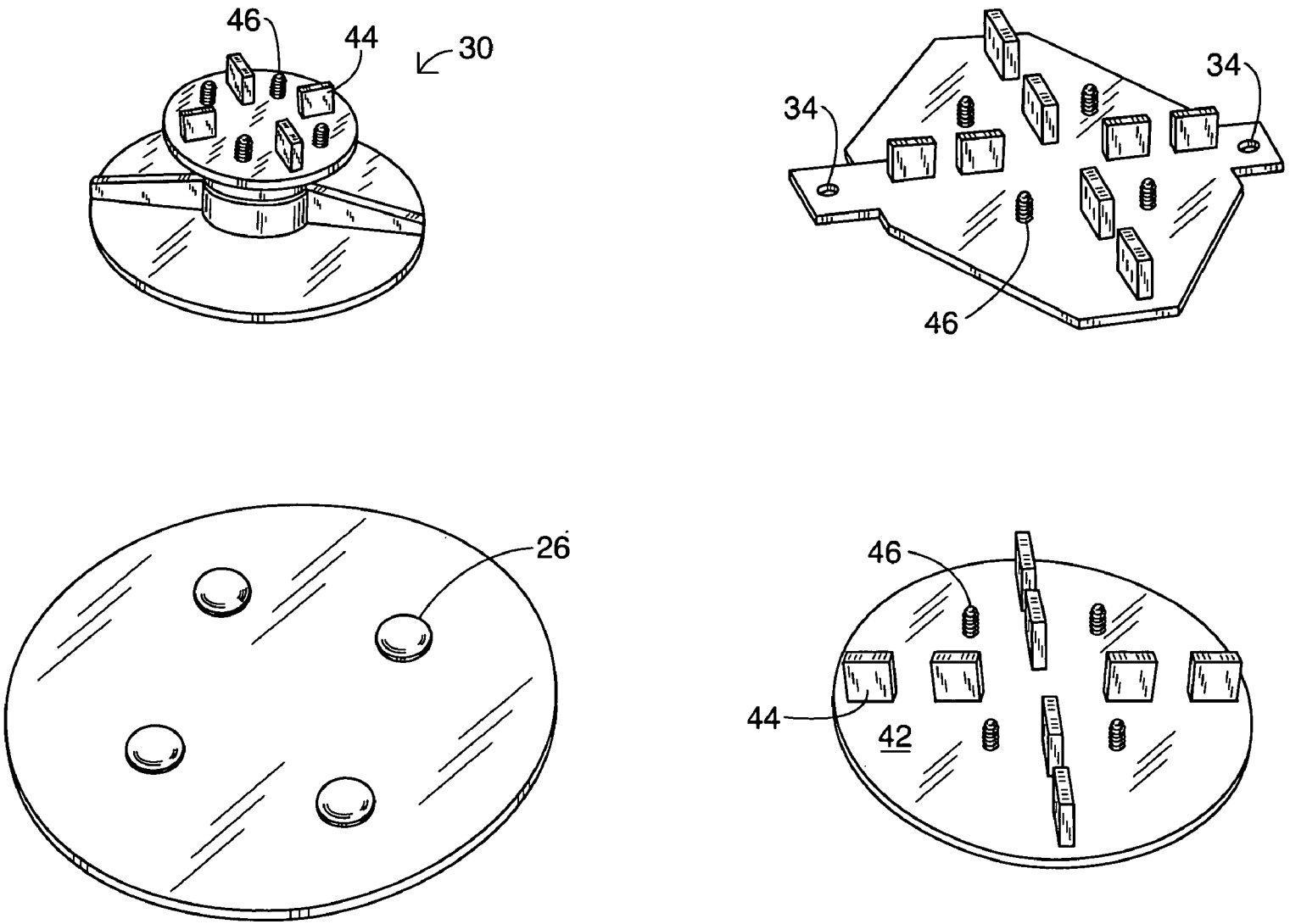
FIG. 7 is a bottom view of the embodiments of FIG. 6.

FIGS. 6 and 7 depict alternate embodiments of decking tile connectors which may be used. Height adjustable pedestals 30 and joist-mounting pedestals 32 are indicated in the figures. As seen in FIG. 6, the joist-mounting pedestal 32 has a channel on its underside to permit placement on a joist or the like. Holes 34 in the pedestal 32 allow the pedestal to be screwed or nailed to the joist. The top of the pedestal 32 has flanges and Christmas tree fasteners 26, like those described previously.

The adjustable pedestals 30 are shown in FIG. 7, one assembled and one disassembled. The pedestal 30 has a base 36 with a male threaded post 38 onto which a female threaded cap 40 is fitted. The rotation of the male cap on the female determines the height. As seen in FIG. 3 the top of the female cap has a plate 42 with flanges 44 and Christmas tree fasteners 46 like those discussed above. These pedestals 30, 32 can be used to support the decking tiles 10 and represent alternate embodiments for the installation of the decking tiles 10. These alternate embodiment pedestals can be modifications or products made by Bison Screwjack, which come in a variety of heights in both the fixed and adjustable models and are constructed of polypropylene, with the added Christmas tree fasteners.

Those of ordinary skill in the art will appreciate that a wide variety of embodiments for the decking tile connector 22 can be envisioned: only a few of which are disclosed here and for the sake of simplicity.

During installation of a deck utilizing decking tiles 10, the area where the installation will take place is preferably level. Where minor discrepancies occur, the adjustable pedestals 30 can be used. Decking tile connectors 22 may then be placed on the ground of the designated deck area for installation of the decking tiles 10. Decking tiles 10 may then be attached to the decking tile connectors 22 using the Christmas tree fastener 26 to hold the decking tile 10 in place. The Christmas tree fasteners 26 are inserted into the predrilled holes 20 of the decking tile 10. Additional decking tile connectors 22 may be placed on the ground and receive additional decking tiles 10. This process continues until the desired dimensions of the deck have been completed. When a joist-supported deck is contemplated, connectors 32 may be used.

Figure 8:
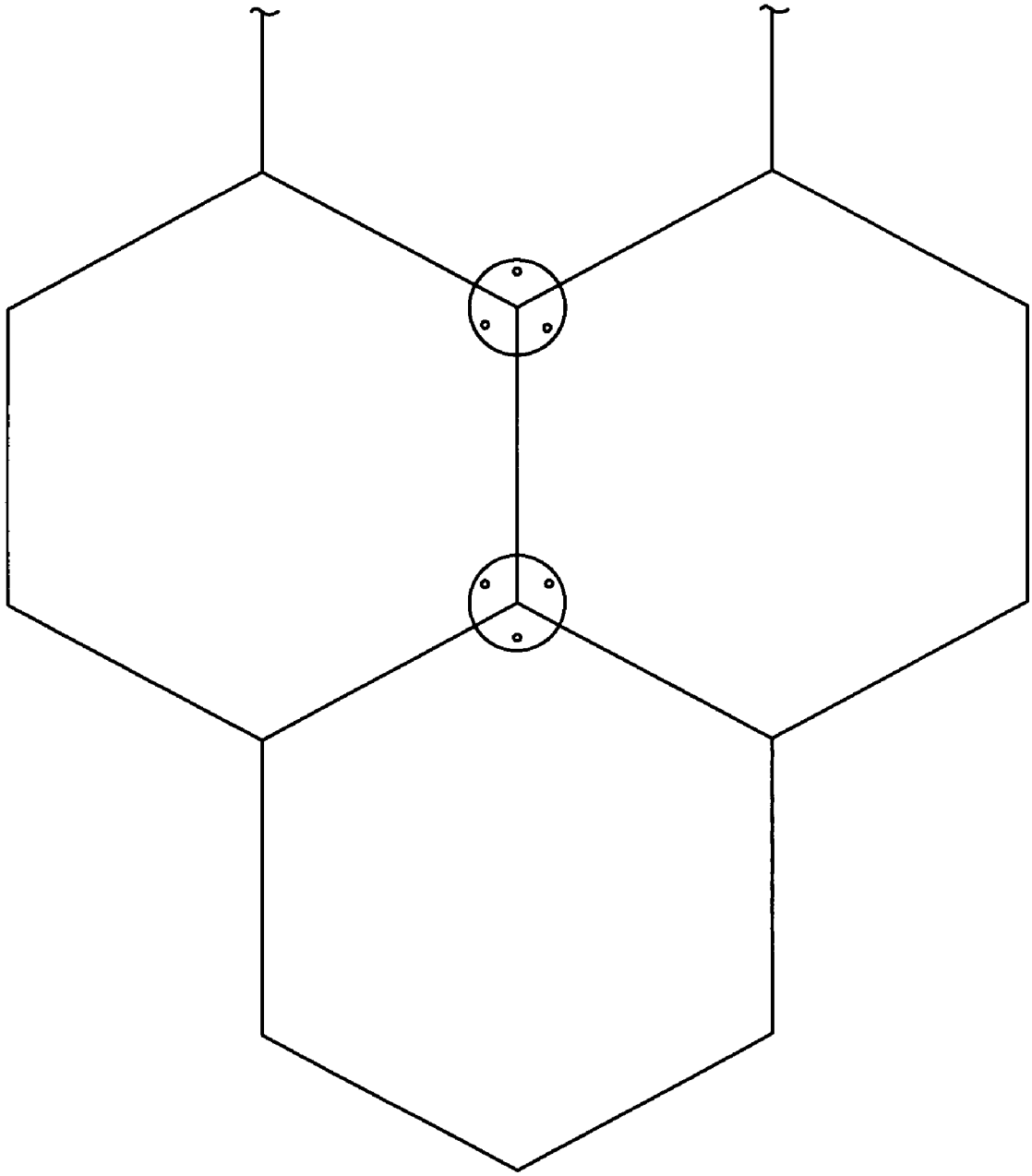
FIG. 8 is a schematic view of another embodiment.

While the most prevalent usage of the invention is likely to involve four square or rectangular tiles per interior connector, other configurations may also be used within the scope of the invention. For example, hexagonal tiles can be used with connectors having 120° pie shaped sectors to receive the tile corners, as seen in FIG. 8.

Certain modifications and improvements will occur to those skilled in the art of reading the foregoing description, it should be understood that all such modifications and improvements have been omitted for the sake of conciseness and readability and are properly within the scope of the following claims.

What is claimed is:

1. A system for the installation of outdoor decking tiles comprising:

a plurality of decking tiles each having a bottom and a top and comprising a plurality of slats and a substantially cylindrical wall defining an opening in one of the slats extending from the bottom toward the top of the tile; and a plurality of decking tile connectors, each having a fastener for insertion into one of the openings to hold the decking tiles in place against lateral movement from the connectors, wherein the fasteners each comprise a stem with a plurality of substantially parallel, round flanges radiating from the stem flexibly with respect to the wall to frictionally engage a tile without distorting the slat such that the top of the tile covers the fastener received by the decking tile.

2. The apparatus according to claim 1, wherein said decking tiles are made of IPE wood.

3. The apparatus according to claim 1, wherein said decking tiles each comprise a plurality of fluted slats made of hardwood.

4. The apparatus according to claim 3, wherein said plurality of fluted slats are fastened to support slats at each end of the fluted slats to form said decking tiles.

5. The apparatus according to claim 4, wherein said fluted slats are fastened to said support slats with screws.

6. The apparatus according to claim 4, wherein said plurality of fluted slats are about 15 mm thick and 65 mm wide.

7. The apparatus according to claim 3, wherein said hardwood decking tile is bankirai.

8. The apparatus according to claim 1, wherein said decking tile is made of hardwood, softwood, or composites of plastic, wood, cellulose and paper fiber.

9. The apparatus according to claim 1, wherein said decking tiles have right angle corners.

10. The apparatus according to claim 9, wherein the decking tiles include upper slats and support slats, ones of the upper slats and support slats defining the right angle corners.

11. The apparatus according to claim 9, wherein the corners have apices and the tiles have drilled holes in a bottom face at a predetermined distance from the apices.

12. The apparatus according to claim 1, wherein said decking tile connector is made of molded plastic.

13. The apparatus according to claim 1, wherein said decking tile connector is circular, rectangular, or square.

14. The apparatus according to claim 1, wherein the connector has spacer flanges.

15. The apparatus according to claim 14, wherein the spacer flanges provide predetermined spacing between said decking tiles after said decking tiles have been installed on said decking tile connector.

16. The apparatus according to claim 14, wherein the flanges define 90° quadrants of the connector and the connector includes Christmas tree fasteners upstanding in each of the 90° quadrants formed by said spacer flanges.

17. The apparatus according to claim 16, wherein said Christmas tree fasteners are made of molded plastic.

18. The apparatus according to claim 16, wherein said Christmas tree fasteners on said decking tile connector are secured in holes in the quadrants of said decking tiles.

19. The apparatus according to claim 14, wherein each decking tile connector can secure at least four decking tiles.

20. A kit of materials for use in installing an outdoor deck comprising:

a plurality of decking tiles having adaptation to receive fasteners; and a plurality of decking tile connectors having fasteners to decking tiles to hold the decking tiles in place against lateral movement from the connectors wherein the fasteners each comprise a stem with a plurality of substantially parallel, flexible, round flanges radiating from the stem and the adaptations in the decking tiles are holes extending from a bottom of the tile toward but not completely through a top of the tile to receive a fastener such that the top of the tile covers the fastener received by the decking tile; and a height adjustable pedestal connected to at least one connector, the height adjustable pedestal for supporting the decking tiles.

21. The kit according to claim 20, wherein said decking tiles comprise fluted slats of hardwood fastened to support slats underneath the fluted slats.

22. The kit according to claim 21, wherein said slats are fastened to said support slats with screws.

23. The kit according to claim 21, wherein said decking tiles have four right angled corners having apices and holes at a predetermined distance from the apices of the corners.

24. The kit according to claim 21, wherein said decking tile connector comprises a molded plastic flat plate.

25. The kit according to claim 24, wherein said plate further includes spacer flanges arranged at 90° to each other, wherein said spacer flanges provide spacing between decking tiles after installation.

26. The kit according to claim 24, wherein said decking tile connector further includes plastic Christmas tree fasteners upstanding in each of said 90° quadrants.

27. The kit according to claim 24, wherein said decking file connector further includes weakened slotted lines, wherein said weakened slotted lines permit said decking connector to be evenly broken for edge effects.

28. A kit of materials for use in installing an outdoor deck comprising:

a plurality of decking tiles, each of the tiles having a bottom, a top, and an outside corner angle with a hole extending from the bottom of the tile toward the top of the tile at a predetermined location with respect to the corner, the hole to receive a fastener such that the top of the tile covers the fastener received by the hole, and a plurality of decking tile connectors, wherein at least one connector includes weakened slotted lines for permitting the connector to be evenly broken off, each of the connectors including a plate, spacer flanges upstanding from the plate arranged to divide the plate into quadrants defined by angles that are the same as the corner angles of the tiles, and fasteners upstanding in the quadrants at locations to align with the holes in the tiles, the fasteners including a stem and a plurality of flexible flanges extending outwardly and surrounding the stem.

29. An outdoor deck comprising: a plurality of decking tiles, each of the tiles including a wooden member having an opening defined by a substantially cylindrical wall extending upwardly from a bottom surface of the tile; and a plurality of decking tile connectors, each having a fastener including a stem extending upwardly in the opening in the wooden member of one of the tiles and a plurality of round flanges extending flexibly from the stem to frictional engagement with the wall, and wherein a top surface of the tile covers the fastener.

30. An outdoor deck according to claim 29, wherein the frictional engagement does not substantially distort the wall.

31. An outdoor deck according to claim 30, wherein the tiles are removable without substantial distortion of the tiles.

32. An outdoor deck according to claim 31, wherein the tiles are removable from the connectors without substantial permanent distortion of the tiles.

33. An outdoor deck according to claim 29, wherein each of the connectors includes an opening and each of the fasteners includes an enlarged head portion below the opening to resist passage of the entire fastener through the opening and thereby secure the fastener to the connector.

* * * * *